United States Patent [19]

Saba

[11] Patent Number: 4,805,834

[45] Date of Patent: Feb. 21, 1989

[54] MAILBOX SIGNAL FLAG

[76] Inventor: T. Paul Saba, 5313 Patriot, Toledo, Ohio 43611

[21] Appl. No.: 121,123

[22] Filed: Nov. 16, 1987

[51] Int. Cl.[4] ..... A47G 29/12

[52] U.S. Cl. ..... 232/34; 232/35

[58] Field of Search ..... 232/35, 34, 17

[56] References Cited

U.S. PATENT DOCUMENTS

| | | | |
|---|---|---|---|
| 1,626,320 | 4/1927 | Alms | 232/35 |
| 3,207,427 | 9/1965 | Madewell | 232/35 |
| 3,391,861 | 7/1968 | Seckler | 232/35 |
| 3,482,543 | 12/1969 | Guidos | 232/35 |
| 3,866,823 | 2/1975 | Grayson | 232/35 |
| 4,711,391 | 12/1987 | Roge et al. | 232/35 |

*Primary Examiner*—Robert W. Gibson, Jr.

*Attorney, Agent, or Firm*—MacMillan, Sobanski & Todd

[57] ABSTRACT

A signal device for attachment to a rural-type mailbox provides a visual indication to a remotely located observer that the box has been opened for insertion of mail. The signal device comprises an elongated, flat, flexible arm including means at one end for adhesively attaching the art to the inner surface of the hinged door of the mailbox, and a brightly colored signal flag at its free end. The configuration of the adhesive juncture of the arm with the lid is such as to facilitate flexing of the arm with minimum stress upon the adhesive layers, whereby the arm can be manually bent over and inserted into the mailbox upon closing of the lid. When the lid is subsequently opened and closed for mail delivery, the arm assumes its normal, erect position with the signal flag displayed outside the box.

5 Claims, 1 Drawing Sheet

MAILBOX SIGNAL FLAG

BACKGROUND OF THE INVENTION

The present invention pertains broadly to signal devices for rural mailboxes, and more particularly to such a device which is actuated upon opening of the mailbox door to provide a visual indication to a remotely located observer that mail has been delivered to the box.

In suburban and rural areas mail is generally delivered by motor vehicle, so that mailboxes are of necessity placed along the highway where they are accessible by the driver of the delivery vehicle. The mailbox may thus be some distance from the residence or business facility to which mail is delivered. It is necessary for the recipient to physically go to the mailbox to retrieve the mail after it is delivered. Due to a number of factors, including highway conditions, volume of mail and time of receipt at the local post office by the carrier, the daily time of delivery to the rural box may vary by a considerable amount. Furthermore, on some delivery days the box holder may not receive any mail. In any event, with conventional mailboxes determination of whether mail has been placed in the box necessitates a trip to the box. Absence of mail in the box would indicate either that mail had not yet been delivered, or that there was no mail for the box holder that day. In either event, additional trips to the box might be required until the question of delivery was resolved.

SUMMARY OF THE INVENTION

In accordance with the present invention, there is provided a signal flag device for attachment to the hinged door of the mailbox, the signal flag being spring actuated for storage within the box so that upon opening of the door the flag will pop up and extend outside the box when the door is closed to provide a clearly visible indication of mail delivery to a remote observer. The device not only may be applied to new mailboxes, but is also particularly suited for retrofitting of existing mailboxes without the use of tools. To that end, it comprises an elongated, flat, flexible arm including means at one end for adhesively attaching the arm to the inner surface of the hinged door of the mailbox. At the opposite, free end of the arm there is provided a brightly colored, highly visible signal flag. The preferred embodiment of the flexible arm includes a reversely bent end segment by which it is attached to the door surface in order to minimize the stress upon the adhesive bonding layer when the arm is deflected for insertion into the mailbox. In an alternate embodiment, the flexible arm is secured to an intermediate backing plate which is, in turn, secured to the surface of the door by an adhesive interlayer member. The connection of the arm to the plate increases the effective length of the arm, and thus facilitates its flexing, with minimum stress upon the adhesive layer.

It is, therefore, a primary object of the invention to provide an improved signal flag device for the mailboxes which will visually indicate to remotely located observers that mail has been placed in the box.

Another object of the invention is to provide such a device which is durable, yet inexpensive to manufacture.

Another object of the invention is to provide such a device which can be readily affixed to existing mailboxes without using tools or drilling holes in the box.

Still another object is to provide such a device which is activated by opening of the door so as to be foolproof in operation.

Other objects and advantages of the invention will become more apparent during the course of the following description, when taken in connection with the accompanying drawing.

BRIEF DESCRIPTION OF THE DRAWING

In the drawing, wherein like numerals refer to like parts throughout.

DESCRIPTION OF THE PREFERRED EMBODIMENT

Figure 1:
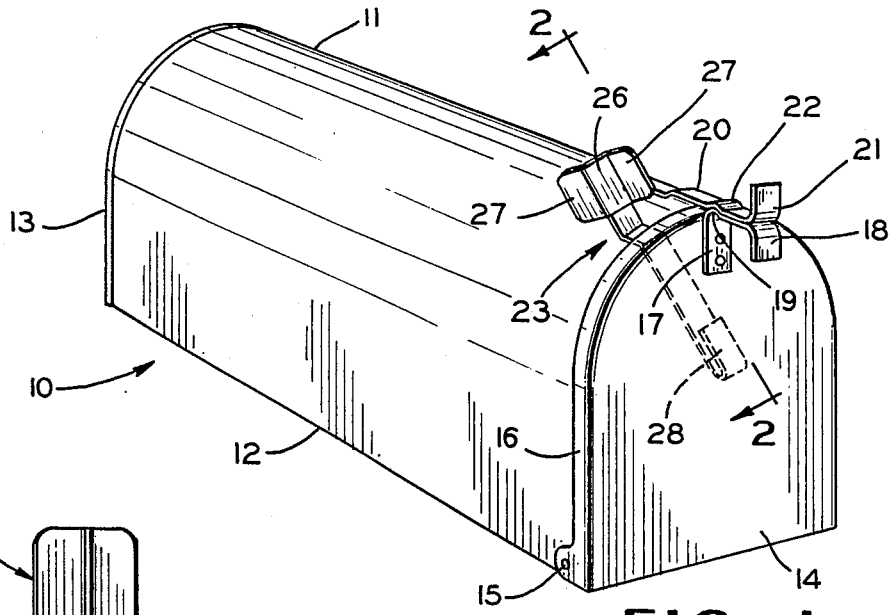
FIG. 1 is a perspective view of a conventional end-opening rural mailbox having the signal flag device of the invention mounted upon its door.

Referring now to the drawings, there is shown generally at 10 a conventional end-opening type rural mailbox incorporating the invention and comprising an inverted U-shaped housing 11 having a flat bottom or floor 12 and enclosed at the rear by a fixed end wall 13. At the opposite or front end there is provided a door 14 hinged at its lower edge to the box as by hinge pins 15. In order to make the mailbox more weather-tight, the lid 14 is formed with a rearwardly bent peripheral flange portion 16 adapted to loosely engage around the outside of the U-shaped housing 11 with the door in the closed position.

Such rural mailboxes are generally mounted atop a post (not shown) set in the ground along the highway, with the door 14 facing the highway so that the door can be readily opened for insertion of mail by a mail carrier riding in an automotive vehicle. To that end, there is suitably affixed to the outer surface of the door 14 a spring strap 17 having a downwardly turned handle 18 and a protuberance 19. A second spring strap 29 carried by the upper portion of the housing 11 has its outer end turned upwardly to form a handle member 21, and includes a detent 22 adapted to cooperate with the protuberance 19 on the spring strip 17 to releasably retain the door 14 in its closed position. The mail carrier can thus readily grasp the handle 18 to open the door for insertion of mail, and then close it to engage the protuberance 19 in the detent 22 for securing it in the closed position.

The novel signal device of the invention is identified generally at 23, and includes a thin, elongated strip 24 of a suitable spring material such as metal or one of the tough, durable plastics. The spring strip is adapted to be adhesively secured to the interior surface of the door 14 at one end of its ends as will be hereinafter explained, and at its other end carries an enlarged brightly colored signal indicia or flag 25. The flag is preferably formed integrally with the strip, but may also be fabricated separately and suitably affixed thereto in a conventional manner. It may be planar in form and of any desired outline, in which case it would be readily visible from the front or rear but might be difficult to see at a distance from the side. In order to enhance its visibility from all directions, in a preferred form as best shown in FIG. 1, the flag includes a central segment 26 having oppositely deflected wings 27 on either side which will be readily visible from the sides.

Figure 2:
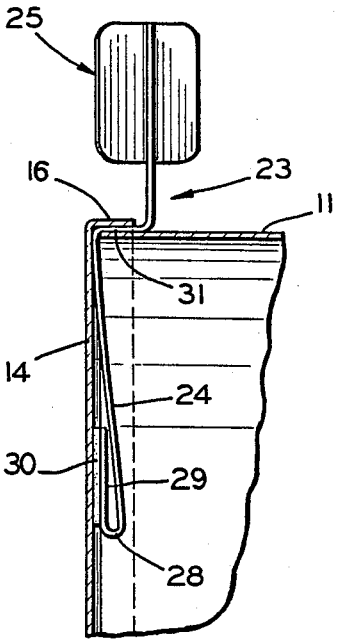
FIG. 2 is an enlarged fragmentary section taken substantially along line 2—2 of FIG. 1.
Figure 3:
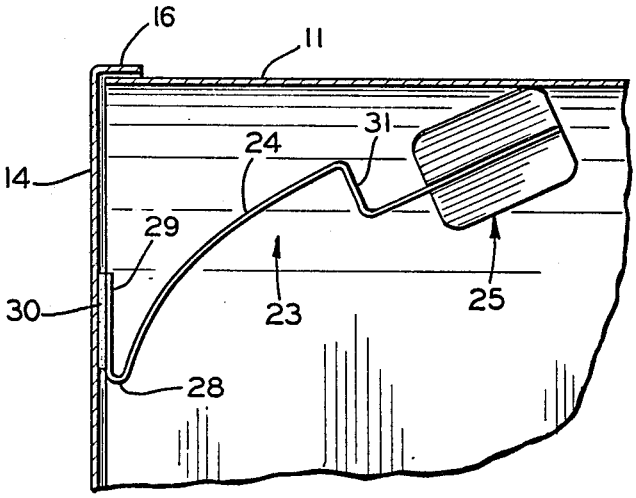
FIG. 3 is an enlarged fragmentary section similar to FIG. 2 and illustrating the signal flag stored within the mailbox.

The spring strip 24 is bent at 28 adjacent the end opposite the flag to form a reversely bent mounting tab 29. As best seen in FIGS. 2 and 3, a strip 30 of double faced adhesive material is adhered to the surface of the mounting tab for affixing the signal device to the surface of the door 14. The adhesive strip may be any of a number of commercially available products, and is preferably of the type comprising a resilient foam interlayer having adhesive material on both faces. The adhesive strip thus cooperates with the spring strip 24, bend 28 and mounting tab 29 to distribute the stress as the signal is bent over for insertion into the box upon closing of the door as will be hereinafter explained. The peripheral flange 16 of the door 14 fits loosely around the U-shaped housing 11 when the door is closed. In order to permit the door to be completely closed with the signal 23 in its erect position, the elongated strip 24 is provided with a transversely extending offsetting leg 31 adapted to be received between the housing 11 and the flange 16 when the door is closed as shown in FIG. 2. Since the offsetting leg is confined between the housing and the flange it not only allows the door to be closed completely, but also insures that the portion of the strip 24 carrying the flag 25 will stand erect to clearly display the flag.

Briefly reviewing operation of the invention, the signal 23 is affixed to the interior surface of the door 14 by means of the adhesive strip 30, with the offsetting leg 31 positioned closely adjacent the peripheral flange 16 of the door. The signal device is then loaded or activated by manually deflecting the elongated spring strip 24 about the point of attachment sufficiently as the door is closed to insert the flag 25 into the box as shown in FIG. 3. In deflecting the spring strip, the bend 28 provides a spring effect and increases the effective length of the spring strip so that the stress at the top of the mounting tab 29, where tension is applied and any failure of the adhesive bond would begin, is minimized. The resilient interlayer of the adhesive strip 30 not only accommodates any projections or depressions on the surfaces of the door and the strip 24 to provide adhesive bonding over the entire area, but also cooperates by absorbing stress from the mounting tab 29 to facilitate deflection of the elongated strip 24 for insertion of the flag 25 into the box with minimum stress upon the adhesive bond.

With the signal device thus inserted in the box prior to mail delivery, it will spring to its normal erect position upon opening of the door for delivery of mail. When the door is again closed by the delivery person, the signal will assume the position illustrated in FIGS. 1 and 2 whereupon the flag 25 will be clearly visible from remote locations, indicating mail has been delivered. As the mail is retrieved and the door closed, the signal device is again loaded into the box to await the next delivery.

Figure 4:
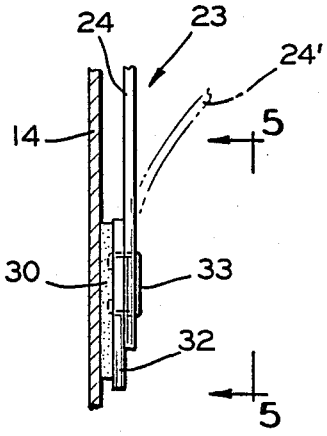
FIG. 4 is an enlarged transverse section of an alternate embodiment for attaching the signal flag to the mailbox.
Figure 5:
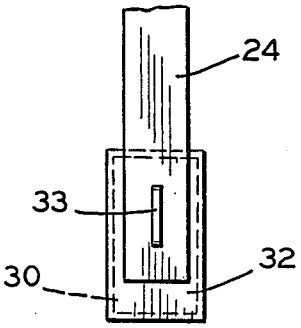
FIG. 5 is a front view of the alternate embodiment taken substantially along line 5—5 of FIG. 4.

There is shown in FIGS. 4 and 5 an alternate embodiment of the mounting arrangement for the signal device 23, the device otherwise being identical to the embodiment of FIGS. 1 to 3. In the alternate embodiment there is affixed to the elongated strip 24 in place of the bend 28 and the mounting tab 29, a thin backing plate 32, as by a staple 33 extending through the strip 24 and the backing plate. The backing plate is of a thin, relatively stiff material such as the sheet aluminum stock used in fabricating gutters and siding, and may be somewhat wider than the elongated strip 24 in order to accommodate a larger adhesive strip 30. It also preferably extends beyond the end of the spring strip 24 to increase the effective length of the spring strip as it is deflected to insert the flag into the mailbox. As the flag is depressed the spring strip will begin to deflect at the top of the staple 33 as shown in broken lines at 24' in FIG. 4, and the backing plate will tend to pivot about its lower edge, compressing the lower portion of the resilient adhesive strip 30 and placing its top portion in tension. Tensile stress at the top edge of the adhesive layer, where any separation from the door 14 or backing plate 32 would begin, is thus minimized.

It is to be understood that the forms of the invention herewith shown and described are to be taken as illustrative embodiments only of the same, and that various changes in the shape, size and arrangement of parts may be resorted to without departing from the spirit of the invention.

What is claimed:

1. A signal device for attachment to a mailbox for indicating to a remotely located observer that mail has been deposited in the box, the mailbox being of the type including a housing open at one end and a door hingedly connected at its lower edge to the open end of the housing and pivotable between open and closed positions, said signal device comprising a thin elongated spring strip having a brightly colored flag member at one end and adhesive means affixing said spring strip to the inner surface of said door adjacent its other end, said spring strip including a reversely bent portion that defines a mounting tab at said other end of said spring strip which is adhesively affixed to the inner surface of said door, said reversely bent portion providing a spring effect thereby increasing the effective length of the spring in order to minimize the stress at the top of said tab where tension is applied and where failure of the said adhesive means would first occur, said spring strip being adapted to normally lie in erect position along the inner surface of said door with said flag member projecting beyond the periphery of said door and to be manually deflected with said door for insertion into said mailbox upon closing of said door, whereby said spring strip returns to said normally erect position with said flag exposed outside said mailbox upon opening and closing of said door for delivery of mail.

2. A signal device for attachment to a mailbox as claimed in claim 1, wherein said adhesive means comprises a double-faced adhesive strip.

3. A signal device for attachment to a mailbox as claimed in claim 2, wherein said adhesive strip comprises a resilient interlayer having adhesive surfaces.

4. A signal device for attachment to a mailbox as claimed in claim 1, wherein said flag member comprises a central segment coplanar with said spring strip, with oppositely deflected wings along either edge of said central segment for enhancing the visibility of said flag.

5. A signal device for attachment to a mailbox as claimed in claim 1, including a peripheral flange on said door adapted to extend over said housing with said door in the closed position, said spring strip including an offsetting leg positioned to lodge between said peripheral flange and said housing when said door is closed with said flag member exposed.

* * * * *